US006047827A

United States Patent [19]

Huang

[11] Patent Number: 6,047,827

[45] Date of Patent: Apr. 11, 2000

[54] ASSEMBLING BIT RECEIVING DEVICE

[76] Inventor: Hung Chen Huang, No. 1-5, Kuang Fu Road, Bih Tou Hsiang, Chang Hua Hsien, Taiwan

[21] Appl. No.: 09/272,527

[22] Filed: Mar. 22, 1999

[51] Int. Cl.[7] ..... B65D 85/20; B65D 6/02; B65D 21/02

[52] U.S. Cl. ..... 206/379; 206/349; 206/372; 220/23.4; 220/4.27

[58] Field of Search ..... 206/349, 379, 206/372; 211/69, 70.6; 220/4.26, 4.27, 23.4, 23.6

[56] References Cited

U.S. PATENT DOCUMENTS

| | | | |
|---|---|---|---|
| 4,253,830 | 3/1981 | Kazen et al. | 206/379 X |
| 4,770,297 | 9/1988 | Chang | 206/379 |
| 4,815,625 | 3/1989 | Filhol et al. | 220/23.4 |
| 5,402,903 | 4/1995 | Mann | 220/23.6 |
| 5,484,057 | 1/1996 | Tzu-Ching | 220/23.4 X |
| 5,503,288 | 4/1996 | Conconi | 220/23.4 X |
| 5,595,294 | 1/1997 | McKenzie et al. | 206/349 |
| 5,706,965 | 1/1998 | Honma et al. | 220/4.27 X |

*Primary Examiner*—Bryon P. Gehman
*Attorney, Agent, or Firm*—Charles E. Baxley, Esq.

[57] ABSTRACT

A bit receiving device includes a body with a block extending from the first end thereof and an engaging hole is defined in the block. A recess is defined in the second end thereof for receiving the block of another device. The two opposite sides of the body each have a dovetail-shaped protrusion extending therefrom and the other two opposite sides of the body each have a dovetail-shaped groove defined therein which is sized to receive the protrusion of another device so that the bit devices are assembled to be a desired tool with a bit engaged with the engaging hole of the front most device.

6 Claims, 7 Drawing Sheets

ASSEMBLING BIT RECEIVING DEVICE

FIELD OF THE INVENTION

The present invention relates to a bit receiving device, and more particularly, to an improved bit receiving device which has a dovetail-shaped groove and a dovetail-shaped ridge extending from the outside thereof so as to connect with each other to be a tool.

BACKGROUND OF THE INVENTION

A conventional bit receiving device (10) and an adapter for receiving a bit in the front end of the shank of the adapter are shown in FIG. 1. Generally, the adapter includes a handle (13) with a aperture (14) defmed in the front end thereof for engaging with the shank (12) which has an engaging recess (11) defmed in the front end thereof so as to engage with a bit (15) to perform as a screwdriver or the like. The bit receiving device (10) has a plurality of holes (100) defmed therein for receiving bits (15) therein. The adapter and the bit receiving device (10) are put in a tool box and when using the adapter, the user picks one of the bits (15) to engage with the engaging recess (11) of the adapter. However, the bit receiving devices (10) are separated pieces and each bit receiving device (10) has a fixed number of holes (100) so that if the user needs more than the numbers of bits (15) that one bit receiving device (10) cannot carry them all, the user has to prepare two or three bit receiving devices (10) with different types of bits (15) received therein. The separated bit receiving devices (10) easily drop from the tool box during work. Besides, the adapter also has a fixed shape and length so that when an object is located at the position where the adapter cannot successfully reach, the user cannot finish his/her job.

The present invention intends to provide a bit receiving device which can be connected with each other to form a tool of desired shape. In other words, the bit receiving devices are assembled to be a tool such as a T-shaped screwdriver with a bit engaged with the front most bit receiving device so that the user may reach the object that the ordinary tool he/she has cannot does. Therefore, the bit receiving device provides a convenient tool that fit the needs of the users.

SUMMARY OF THE INVENTION

In accordance with one aspect of the present invention, there is provided a bit receiving device comprising a body having a block extending from the first end thereof and an engaging hole defined in the block thereof so as to connect a bit therein. A recess is defmed in the second end of the body so as to receive the block of another device. The outside of the body has a protrusion extending therefrom and a groove defined therein so that the devices can be assembled together by receiving the protrusion of one device in the groove of another device. A bit is engaged with the engaging hole of the front most device.

The main object of the present invention is to provide a bit receiving device which has a protrusion and a groove so as to connect with other devices to perform as a screwdriver or the like.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
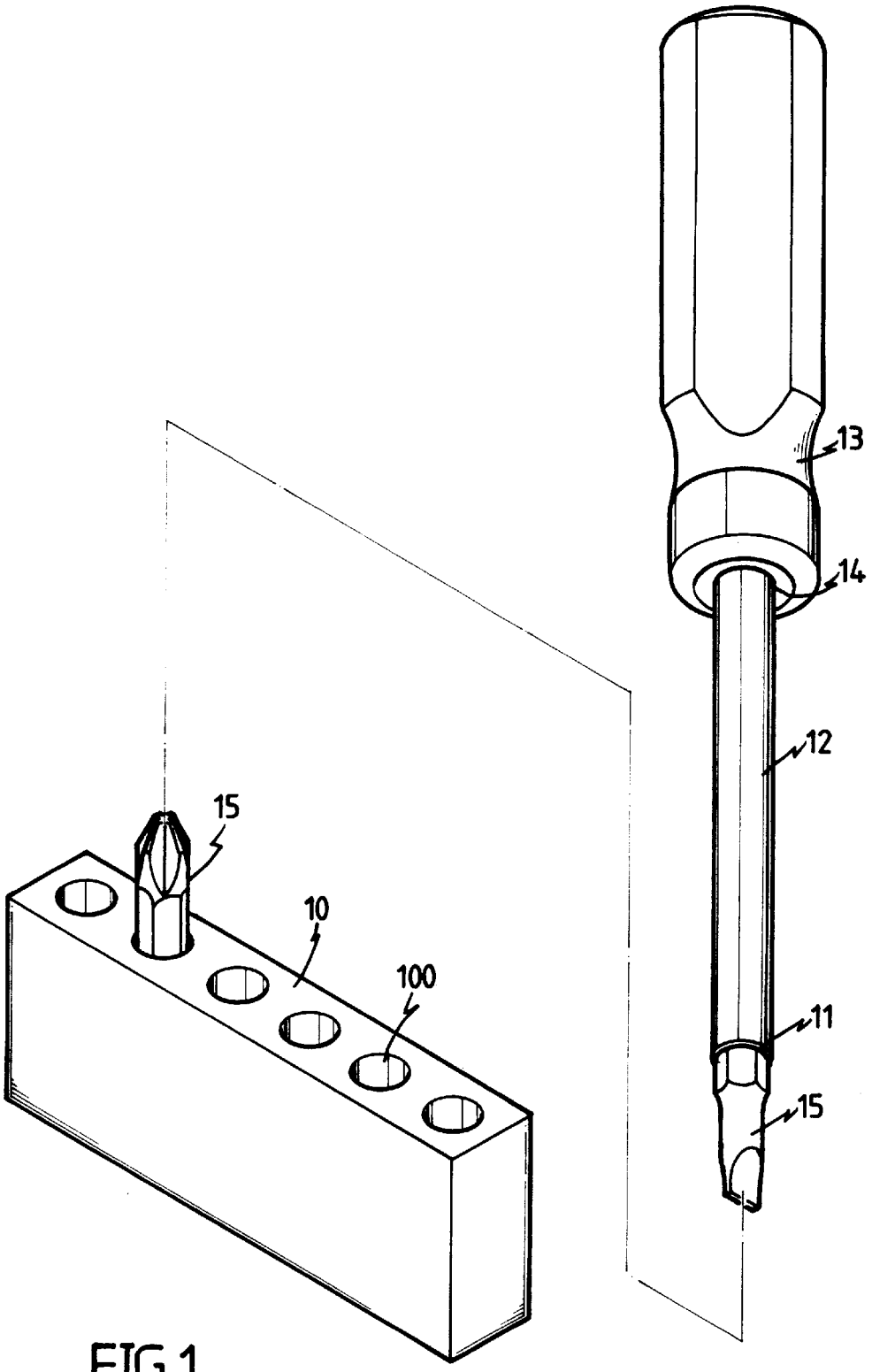
FIG. 1 PRIOR ART
FIG. 1 is an exploded view of the conventional bit receiving device and a bit adapter.
Figure 2:
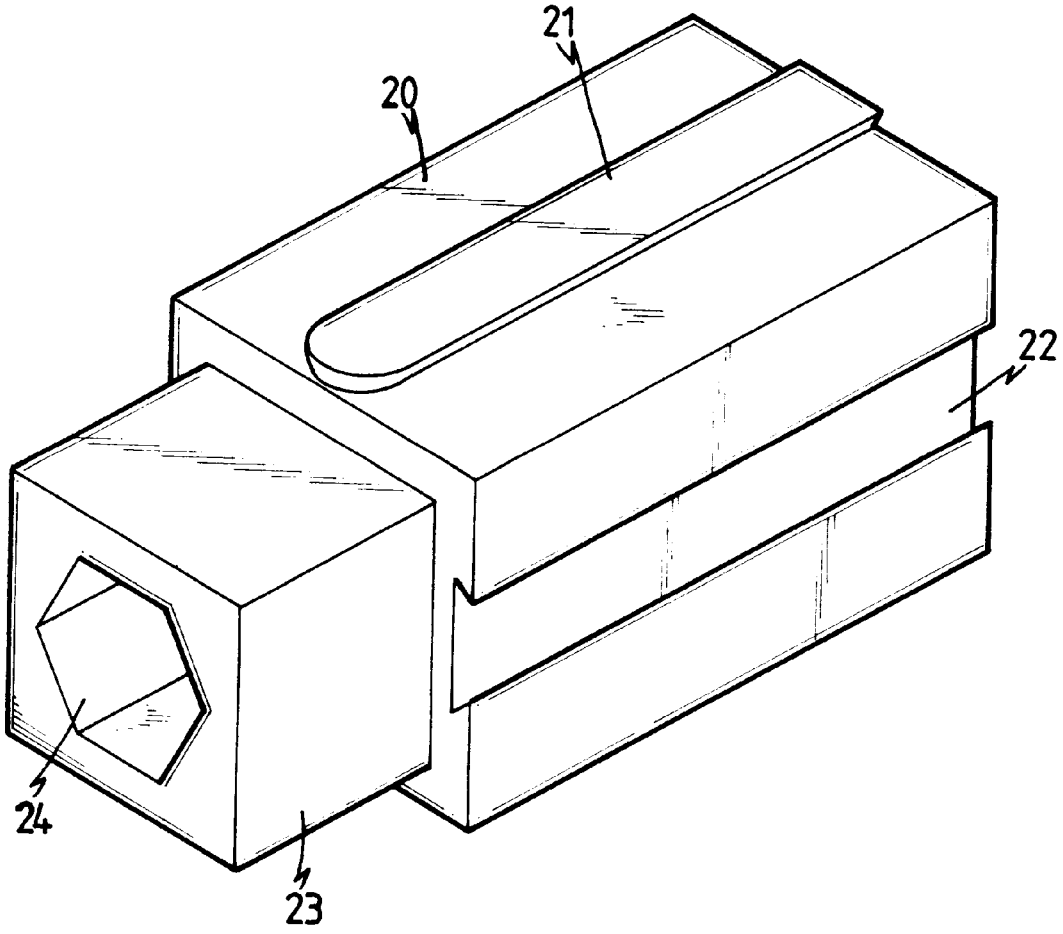
FIG. 2 is a perspective view of the bit receiving device in accordance with the present invention.
Figure 3:
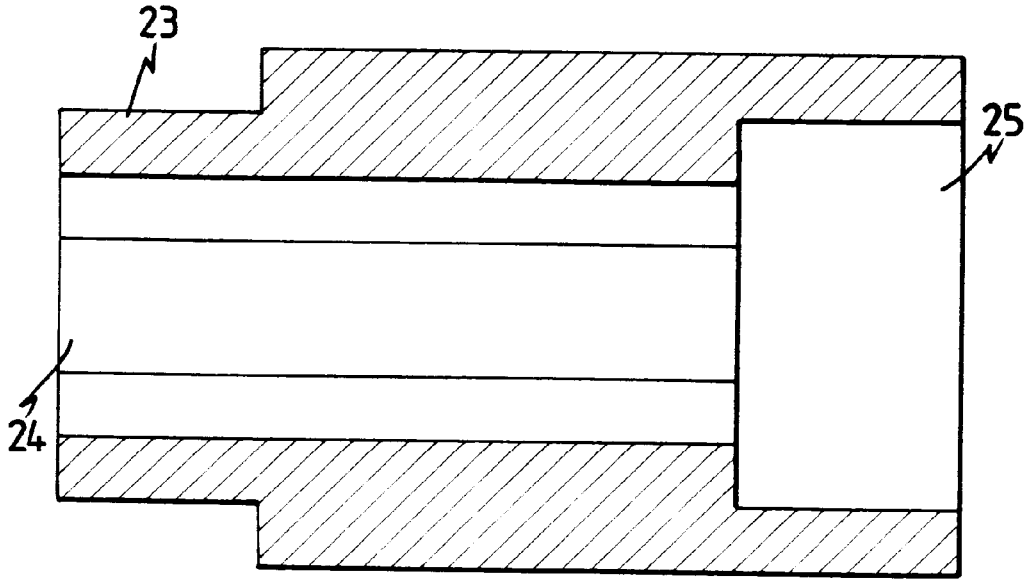
FIG. 3 is a side elevational view, partly in section, of the bit receiving device in accordance with the present invention.
Figure 4:
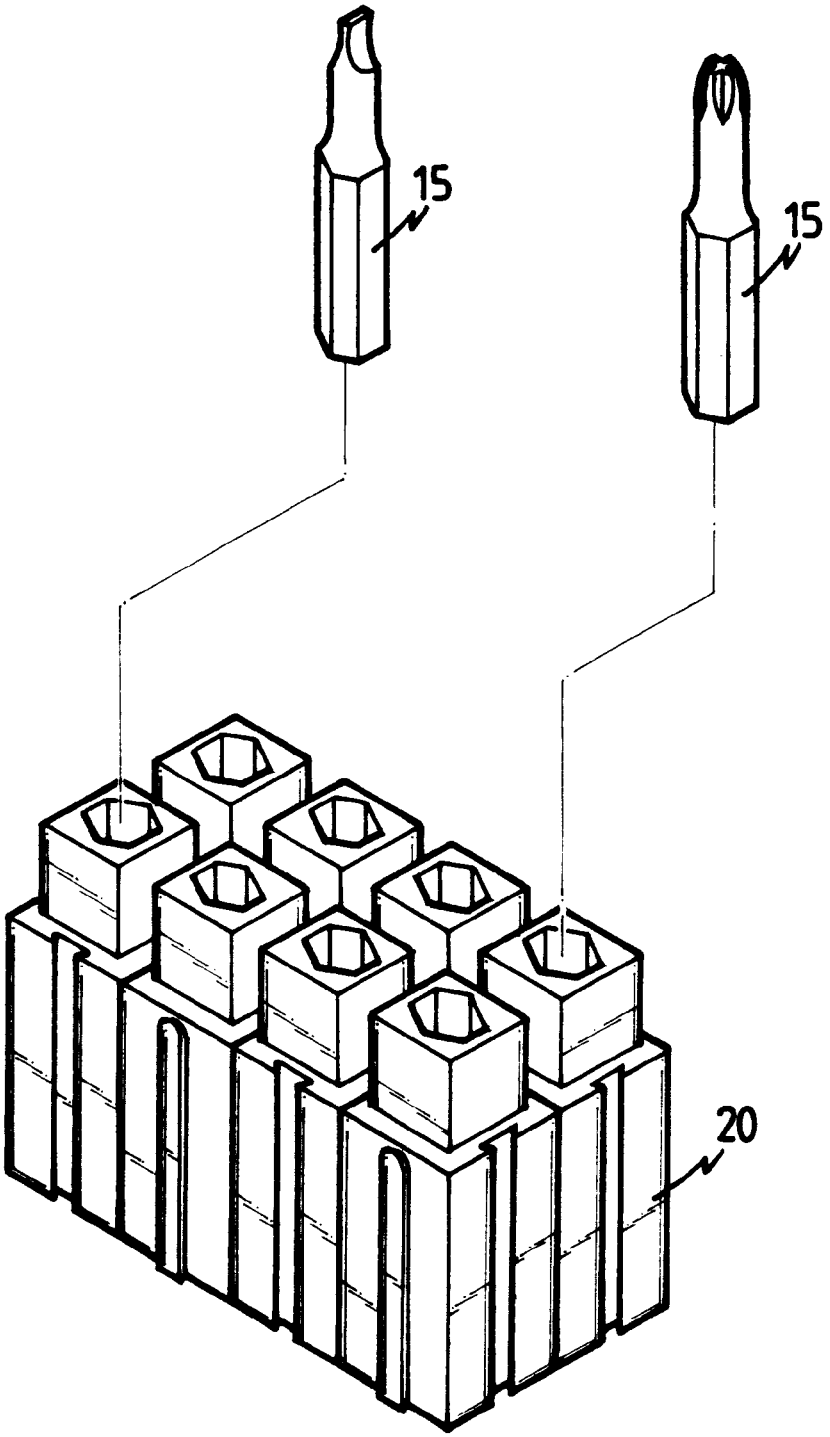
FIG. 4 is an exploded view of a first embodiment of the assembled bit receiving devices and two bits to be engaged with the devices in accordance with the present invention.

Referring to FIGS. 2 and 3, the bit receiving device in accordance with the present invention comprises a body (20) with four sides and having a block (23) extending from the first end thereof and an engaging hole (24) is defined in the block (23) thereof, The block (23) has four sides and the engaging holes (24) is a hexagonal hole (24) so as to engage with a bit (15) therein (see FIG. 4). A recess (25) is defmed in the second end of the body (20) and sized to receive the block (23) of another bit receiving device. The two opposite sides of the body (20) each have a dovetail-shaped protrusion (21) extending therefrom and the other two opposite sides of the body (20) each have a dovetail-shaped groove (22) defined therein which is sized to receive the dovetail-shaped protrusion (21) of another bit receiving device.

Referring to FIG. 4, the bit receiving devices can be connected together by receiving the protrusion (21) in the groove (22) of the adjacent bit receiving device so as to form a large bit receiving device to receive more bits (15) therein. The numbers of the devices can be varied according the users' needs.

Figure 5:
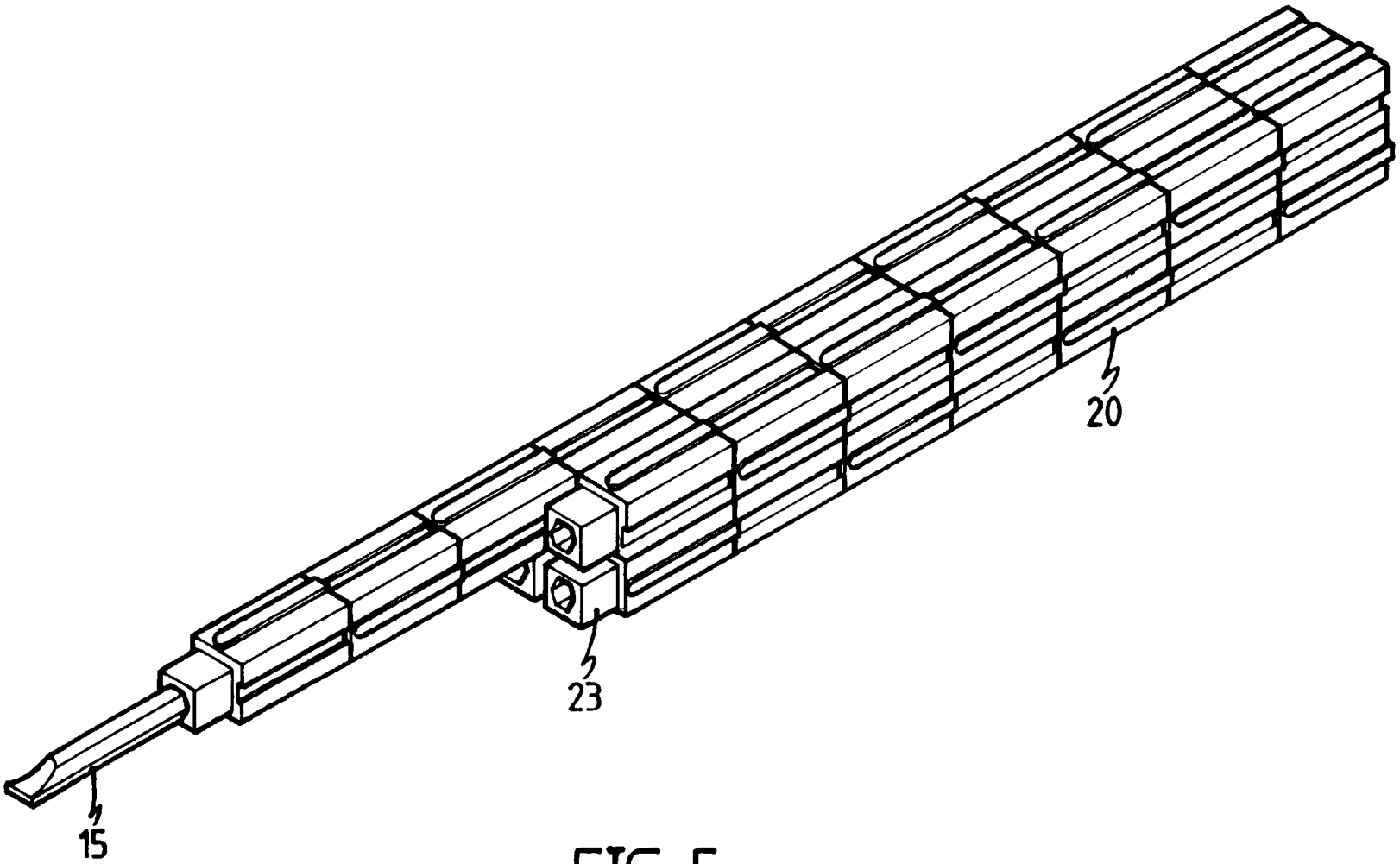
FIG. 5 is a perspective view of the second embodiment of the bit receiving devices assembled as a screwdriver.

FIG. 5 shows that a plurality of the assembled unit composed of four bit receiving devices as shown in FIG. 4 are connected by engaging the blocks (23) of one assembled unit with the recesses (25) of another assembled unit to form an elongated handle portion. Three bit receiving devices are connected to the front end of the handle portion with a bit (15) engaged with the front most bit receiving device so as to perform as a screwdriver.

Figure 6:
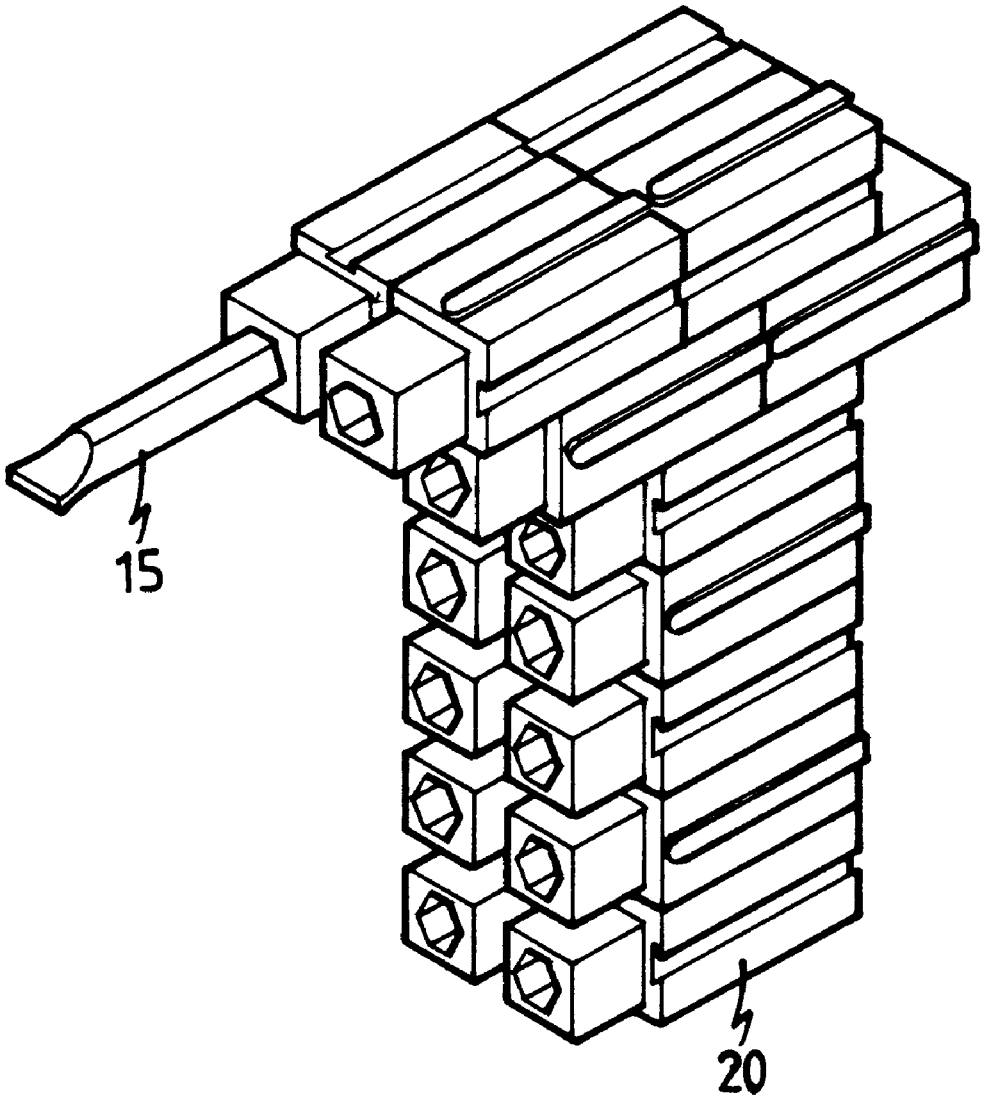
FIG. 6 is a perspective view of the third embodiment of the bit receiving devices assembled as another type of screwdriver.
Figure 7:
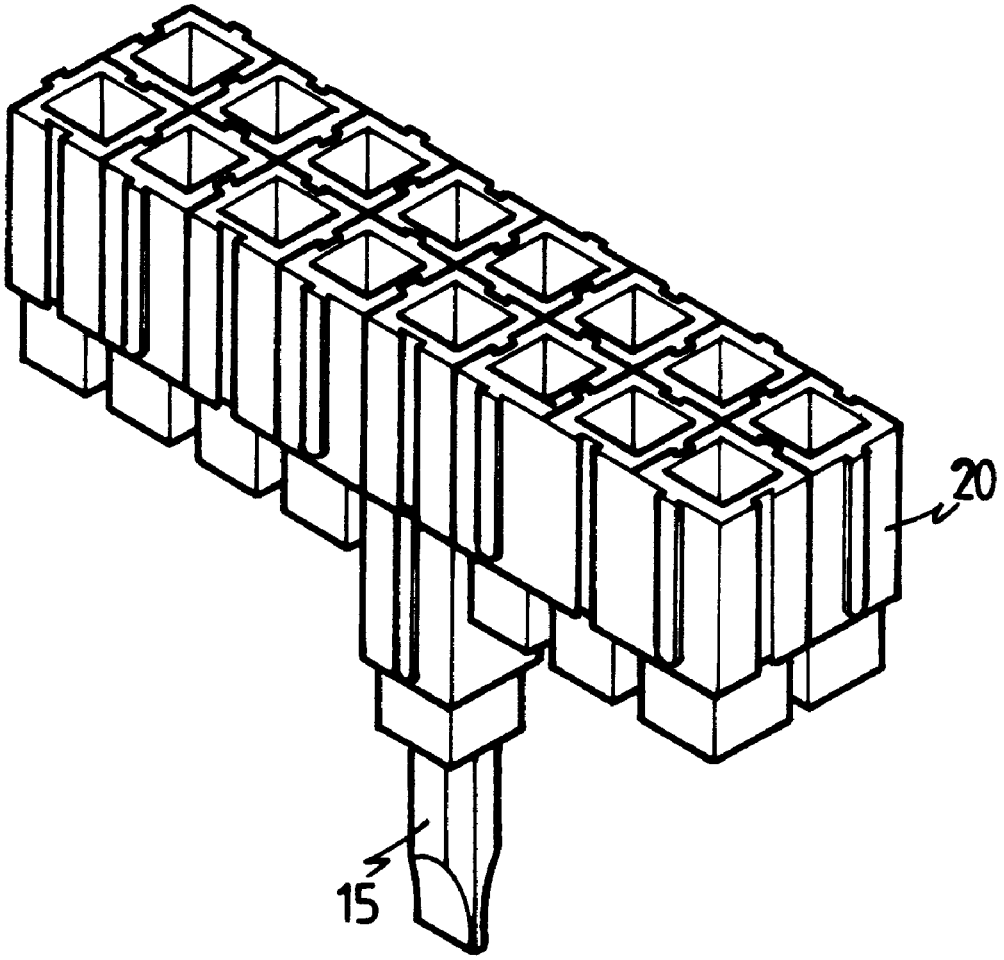
FIG. 7 is a perspective view of the fourth embodiment of the bit receiving devices assembled as a screwdriver with a T-shaped handle.

FIG. 6 and FIG. 7 respectively show two different forms of the assembled bit receiving devices, wherein the bit (15) can be transversely connected to the top of the assembled bit receiving devices as shown in FIG. 6. In FIG. 7, the bit receiving devices are assembled to be a T-shaped tool with the bit (15) laterally connected to the mediated portion of the assembled unit.

The bit receiving device in accordance with the present invention is easily connected to each other to perform as different types of tool so that it is convenient for the users to assemble the devices in different ways to take care of situations that the ordinary tool cannot handle.

While we have shown and described various embodiments in accordance with the present invention, it should be clear to those skilled in the art that further embodiments may be made without departing from the scope and spirit of the present invention.

What is claimed is:

1. An assembling bit receiving device comprising:

a body (20) having a block (23) extending from a first end thereof and an engaging hole (24) defined in said block (23), a recess (25) defined in a second end of said body (20) and said recess (25) being sized to receive said block (23), at least one protrusion (21) extending from an outside of said body (20) and at least one groove (22) defmed in said outside of said body (20), each said groove (22) sized to receive each said protrusion (21).

2. The bit receiving device as claimed in claim 1, wherein each said protrusion (21) is a dovetail-shaped protrusion.

3. The bit receiving device as claimed in claim 1, wherein each said groove (22) is a dovetail-shaped groove.

4. The bit receiving device as claimed in claim 1, wherein said engaging hole (24) is a hexagonal hole.

5. The assembling bit receiving device as claimed in claim 1, wherein said body (20) has four sides and two opposite sides of said four sides each have said at least one protrusion (21) extending therefrom and the other two opposite sides each have said at least one groove (22) defined therein.

6. The bit receiving device as claimed in claim 1, wherein said block (23) has four sides.

* * * * *